United States Patent [19]

Elvin

[11] Patent Number: 4,551,006

[45] Date of Patent: Nov. 5, 1985

[54] THERMAL CONSERVATION APPARATUS

[75] Inventor: Warren G. Elvin, Rochester, N.Y.

[73] Assignee: Eastman Kodak Company, Rochester, N.Y.

[21] Appl. No.: 619,652

[22] Filed: Jun. 11, 1984

[51] Int. Cl.[4] ..... G03G 15/20

[52] U.S. Cl. ..... 355/14 FU; 355/3 FU; 219/216; 432/60

[58] Field of Search ..... 355/14 FU, 3 FU, 14 SH, 355/3 SH; 219/216, 388, 405; 432/60, 65

[56] References Cited

U.S. PATENT DOCUMENTS 3,356,831 12/1967 Andrus et al. .
3,667,742 6/1972 Kamola .
3,849,907 11/1974 Lynch .
3,922,520 11/1975 Moore ..... 219/216
3,937,919 2/1976 Clerx et al. .
3,998,584 12/1976 Wada et al. .

FOREIGN PATENT DOCUMENTS 2321837 11/1974 Fed. Rep. of Germany .

OTHER PUBLICATIONS

Research Disclosure No. 16732, Mar. 1978, "Thermal Conservation Assembly for Roller Fuser".

*Primary Examiner*—R. L. Moses
*Attorney, Agent, or Firm*—Donald D. Schaper

[57] ABSTRACT

Thermal conservation apparatus for use in reproduction apparatus in which copy sheets carrying unfused images are moved successively along a path through a heated fuser. The thermal conservation apparatus includes a moveable gate assembly located adjacent to the heated fuser in the sheet path. A control is coupled to the gate assembly for opening the assembly to pass a copy sheet and for closing the assembly when a copy sheet is not passing to minimize the loss of thermal energy from the heated fuser along the sheet path. The gate assembly may include gates at both the entrance to or exit from the fuser or at either location. The control maintains the gate assembly continuously open when successive sheets are spaced closely together to facilitate movement of the sheets through the fuser. The gate assembly may include members on opposite sides of the path which are moveable towards and away from one another to closed and open positions.

10 Claims, 5 Drawing Figures

THERMAL CONSERVATION APPARATUS

BACKGROUND OF THE INVENTION

This invention relates in general to reproduction apparatus in which copy sheets carrying unfused images are moved successively along a path through a heated fuser. More particularly, this invention relates to thermal conservation apparatus for minimizing the loss of thermal energy from a heated fuser along the copy sheet path.

In reproduction apparatus such as electrographic apparatus, unfused toner images of originals are generally formed on copy sheets which are moved successively through the electrographic apparatus and which are permanently fused by means of a heated fuser through which the copy sheets are passed. A heated fuser creates problems within the electrographic apparatus because of the heat produced. Since the fuser may be located closely to the photoconductive member, heat from the fuser may undesirably change the imaging characteristics of the photoconductive material. Copy sheet transport apparatus such as vacuum belts located before or after the fuser also tend to draw heat away from the fuser. Since a heated fuser may be the largest consumer of power within electrographic apparatus, it has been found desirable to conserve the thermal energy of the fuser as much as possible. Such conservation techniques have included the use of insulated covers which confine the heat within the fuser. Such covers are shown, for example, in U.S. Pat. Nos. 3,998,584; 3,937,919; and 3,667,742. In order to gain access to the fuser, the cover may be moveable such as shown in U.S. Pat. No. 3,356,831 and Research Disclosure No. 16732 dated March 1978, entitled "Thermal Conservation Assembly for Roller Fuser," (published by Kenneth Pobl. Ltd., Hamphine, U.K.). Such conservation assemblies are still not effective in preventing the escape of heat along the path of the copy sheets. It has been proposed in U.S. Pat. No. 3,849,907 to provide fusing apparatus in which copy sheet curl is reduced by means of brush-like seals adjacent the fusing zone for limiting air flow at the fusing zone. It has also been proposed in German Pat. No. 2,321,837 to provide at the entry to and exit from a heated fixer, fireproof shutters which are held by heat-sensitive wires which melt when the heat inside the fixer exceeds a safe level so that the shutters intersect the copy sheet path and isolate the fixer. These shutters are not selectively moveable into and out of the copy sheet path however.

It would thus be desirable to provide a heated fuser in which thermal energy is conserved by minimizing the loss of thermal energy from the fuser along the path of the copy sheets in order to prevent overheating of adjacent components such as a photoconductor and to reduce the amount of energy consumed by the heated fuser. Such conservation apparatus is especially desirable during warm-up and stand-by and during intervals between copy sheets. However, it would also be desirable to inhibit the conservation apparatus when successive copy sheets are spaced closely together to facilitate movement of sheets through the fuser.

SUMMARY OF THE INVENTION

According to the present invention, there is provided thermal conservation apparatus for minimizing the loss of thermal energy from a heated fuser along a copy sheet path. The thermal conservation apparatus is usable in reproduction apparatus in which copy sheets carrying unfused images are moved successively along a path through a heated fuser. The thermal conservation apparatus includes a selectively moveable gate assembly located adjacent to the heated fuser in the copy sheet path and control means, coupled to said gate assembly for opening said assembly to pass a copy sheet and for closing said gate assembly when a copy sheet is not passing to minimize the loss of thermal energy from said fuser along said path. The gate assembly may be maintained continuously open by said control means when successive copy sheets are spaced closely together to facilitate movement of said sheets through said fuser. The gate assembly may include members on opposite sides of the path which are selectively moveable to open and closed positions.

The invention and its objects and advantages will become more apparent in the detailed description of the preferred embodiment presented below.

BRIEF DESCRIPTION OF THE DRAWINGS

In the detailed description of the preferred embodiments of the invention, reference is made to the accompanying drawings, like numbers representing like elements, in which.

DESCRIPTION OF THE PREFERRED EMBODIMENTS

Figure 1:
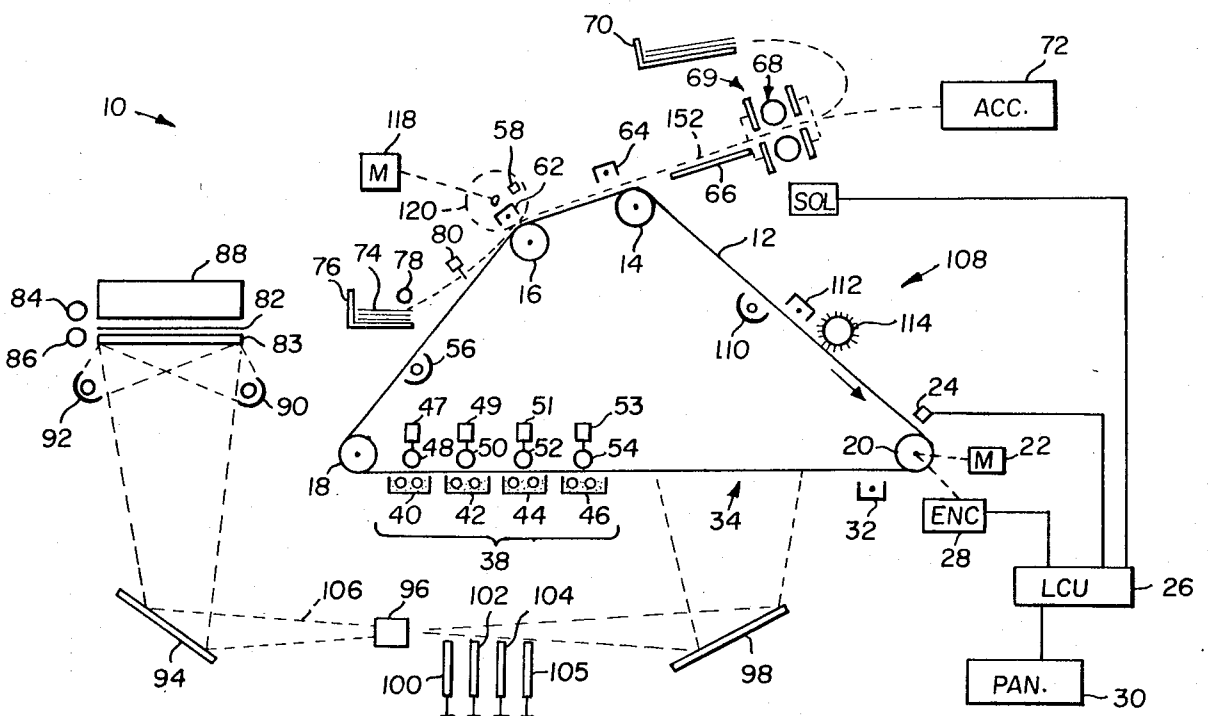
FIG. 1 is a diagrammatic view of reproduction apparatus in which the thermal conservation apparatus of the present invention may be used.

Referring now to FIG. 1, there is shown illustrative reproduction apparatus incorporating one embodiment of thermal conservation apparatus according to the present invention. As shown, reproduction apparatus such as electrographic copier 10 includes an endless image transfer member such as photoconductive belt 12. Belt 12 (which may be of the type described in U.S. Pat. No. 3,615,414 issued Oct. 26, 1971, in the name of Light), is rotatably supported on rollers 14, 16, 18, and 20 which are journaled in the copier frame. Belt 12 is driven in a clockwise direction by means of motor 22. Belt 12 has a plurality of sequentially spaced, non-overlapping image areas or frames which successively pass electrophotographic processing stations (charge, expose, develop, transfer, clean) located adjacent to the path of belt 12. For examples, if $8\frac{1}{2}'' \times 11''$ and $8\frac{1}{2}'' \times 14''$ documents are to be copied, they are imaged onto belt 12 so that the longer dimension (i.e., 11" or 14") spans the belt and the shorter dimension (i.e., $8\frac{1}{2}''$) is in the direction of belt movement. If there is a spacing between adjacent image areas of $1\frac{1}{2}''$ (interframe distance), then each frame will be 10" and if belt 12 has six frames, it will be 60" long. It will be appreciated that these dimensions are illustrative only and that belt 12 may have other dimensions. For example, the image areas may be larger or smaller, the interframe distances may be larger or smaller, the length of belt 12 may be larger or smaller, the number of frames may be greater or lesser, etc.

Belt 12 has timing marks (such as regularly spaced perforations) which are sensed by appropriate means such as timing signal generator 24 to produce timing signals which are supplied to a logic and control unit (LCU) 26. LCU 26 includes a microprocessor such as the Model 8085 microprocessor available from the Intel Corporation of Santa Clara, Calif. Encoder 28 associated with drive motor 22 also produces timing signals for LCU 26 which are used in conjunction with the timing signals produced by generator 24 to control the operation of copier 10. Control and display panel 30 connected to LCU 26 has operator selectable switches for programming the operation of copier 10 and has operator observable displays which inform the operator of the selected functions and of other information.

Copier 10 may be operated in a single-image simplex mode in which images are produced on one side of copy sheets in a single-pass through the reproduction apparatus to produce single-image simplex copies. In another mode, multiple images are formed on a single side of a copy sheet during a single pass of the sheet through the apparatus to produce multiple-image simplex copies. Although the rated or nominal number of images produced per hour or minute remains the same for each mode, the number of copies produced will be less in the multiple-image mode than in the simplex mode. For example, the copier may be rated to produce 60 copies per minute and in the single-image simplex mode, 60 copies per minute will be produced in a continuous run. However, in the multiple-image simplex copy mode, two or more images are formed on one side of a copy sheet. Thus, if three color separation images are superimposed on one side of a copy sheet, the effective copy rate will be one third the simplex copy rate or 20 copies per minute.

In order to effect these modes, copier 10 includes a series of processing stations located about photoconductive belt 12. As described in the above-mentioned U.S. Pat. No. 3,615,414, belt 12 includes a photoconductive insulating layer and a conductive layer in conductive contact with the insulating layer. The photoconductive layer of belt 12 is initially charged with an electrostatic charge of a first polarity by means of a corona charging electrode 32. An exposure station 34 is provided to expose charged image areas of belt 12 to the radiation image of an original. Upon exposure, the photoconductive layer is selectively discharged in an image-wise manner to produce a latent electrostatic image corresponding to the original image.

The electrostatic latent image is then developed at development station 38 which includes a plurality of magnetic brush development stations 40, 42, 44, and 46, which selectively develop the image with toner particles having an opposite charge to the latent electrostatic image. The toner particles of each of the stations are of a different color, e.g., station 40 is provided with cyan toner particles; station 42 is provided with magenta toner particles; station 44 is provided with yellow toner particles and station 46 is provided with black toner particles. Backup rollers 48, 50, 52, and 54 are selectively moved by respective solenoids 47, 49, 51 and 53 to deflect belt 12 into operative relationship with respective stations 40, 42, 44, and 46. Alternatively, rollers 48, 50, 52 and 54 may be stationary and development stations 40, 42, 44, and 46 may be selectively moved into and out of operative relationship with belt 12. It will be understood that development stations having toner particles of other colors may be provided and that more or less development stations may also be provided.

A post-development erase lamp 56 reduces the electrostatic attraction between the toner image and belt 12 to facilitate transfer to a copy sheet and to reduce photoconductor fatigue.

Copy sheet positioning apparatus is provided to position a copy sheet to receive successive images in superimposed relationship from successive image areas on belt 12. The positioning apparatus may be similar to that disclosed in commonly assigned U.S. Pat. No. 4,410,263, issued Oct. 18, 1983, for "Sheet Handling Device For Image Transfer In An Electrographic Copier," by G. B. Gustafson, et. al. The apparatus includes a rotatably mounted vacuum tow bar 58 which captures the lead and trail edges of a copy sheet 74 with the portion intermediate the captured edges self supporting. A transfer charger 62 is provided to transfer toner images from belt 12 to sheet 74. Detack charger 64 neutralizes the charge on sheet 74.

A copy sheet is separated from belt 12 at separating roller 14 and is carried by air transport 66 to heated roller fuser 68 where the toner image(s) is permanently fused to the copy sheet. According to the present invention, thermal conservation apparatus 69 is provided to minimize the loss of thermal energy from fuser 68 along the copy sheet path 152. The copy is then delivered either to an output tray 70 or to a copy handling accessory 72 such as a sorter or a finisher.

Copy sheets 74 are supplied successively from supply 76 by means of oscillating vacuum roller 78 to registration mechanism 80 which eliminates skew from a fed sheet 74 and which registers sheet 74 with a toner image on belt 12.

Originals 82 to be reproduced are positioned on transparent platen 83 either by hand, by feed rollers 84 and 86 or by recirculating document feeder 88. Document 82 is illuminated by flash lamps 90 and 92 to produce a radiation image which is projected upon belt 12 at exposure station 34 by means of mirror 94, lens 96, and mirror 98. A plurality of filters such as red filter 100, green filter 102, blue filter 104 are selectively insertable into optical path 106 by respective solenoids 99, 101, 103 to form corresponding latent electrostatic color images on successive image frames of belt 12. A neutral density filter 105 is also insertable into path 106 by solenoid 107 when forming a latent image corresponding to a black only original or a black portion of a multicolor original.

A cleaning station 108 is provided to effect mechanical and electrical cleaning of photoconductive belt 12. Station 108 includes a cleaning assist erase lamp 110 which exposes the photoconductor to radiation to further reduce any charge remaining from the detack and transfer steps; a cleaning assist charger 112 which impresses an AC charge on photoconductive belt 12 to neutralize the charges on untransferred toner particles; and a brush 114 which removes any residual toner from belt 12 and deposits it in a suitable collection container (not shown).

When copier 10 is operated in a single-image simplex mode, that is, when single images are formed on only one side of copy sheets, a document 82 is positioned on platen 83 and a light image is projected onto an electrostatically charged image frame of belt 12 at exposure station 34 to form an electrostatic latent image corresponding to the original. If this latent image is of a business document, such as a letter or the like, it may be developed with black toner or any other selected color toner. In such case, neutral density filter 105 may or may not be inserted into optical path 106. LCU 26 actuates solenoid 53 to move backup roller 54 so that belt 12 is moved into operative relationship with black magnetic brush development station 46 to develop the latent electrostatic image with black toner particles. LCU 26 causes feed roller 78 to feed copy sheet 74 to registration mechanism 80 which registers it with the black toner image on belt 12. Tow bar 58 is held inactive away from transfer charger 62 which transfers the black toner image to sheet 74. Detack charger 64 neutralizes the attraction between sheet 74 and belt 12, and sheet 74 separates from belt 12 at separation roller 14 and is transported by air transport 66 to fuser 68 and from there to output tray 70 or copy handling accessory 72.

Successive single-image simplex copies are produced in the same manner and will move successively through copier 10 along path 152 with a small spacing between successive sheets. In the example described above, if $8\frac{1}{2}''$ wide copy sheets are being processed by copier 10, there will be a spacing of $1\frac{1}{2}''$ between successive copy sheets with a spacing of 10" between leading edges of such sheets. If the copier is rated to produce 60 images per minute, in the simplex mode, 60 copy sheets per minute will move through copier 10 during a continuous run.

In another mode of operation, copier 10 produces multiple images on one side of a copy sheet to produce multiple-image, simplex copies. The images may be superimposed, matrixed or adjacent on the copy sheet. A multi-colored document 82 (such as a color photograph) is positioned on platen 83 either manually or by means of feed rollers 84 and 86 or recirculating document feeder 88. Document 82 is illuminated a plurality of times such as three times by flash lamps 90 and 92 to form three successive light images which are projected along optical path 106 by mirrors 94 and 98 and lens 96. Red filter 100, green filter 102, and blue filter 104 are successively inserted into light path 106 through selective actuation by LCU 26 of respective solenoids 99, 101, and 103 to form three successive latent electrostatic color separation images of document 82 on belt 12 at exposure station 34. LCU 26 then actuates solenoid 47 to move roller 48 and belt 12 into operative relationship with development station 40 to develop the red electrostatic latent image with complimentary colored cyan toner particles; actuates solenoid 49 to move backup roller 50 and belt 12 into operative relationship with development station 42 to develop the green electrostatic latent image with complimentary colored magenta toner particles; and actuates solenoid 51 to move backup roller 52 and belt 12 into operative relationship with development station 44 to develop the blue electrostatic latent image with complimentary colored yellow toner particles.

It will be appreciated that only one backup roller is moved into contact with belt 12 for each latent electrostatic image passing development station 38 so that only the selected development station is effective to bring the appropriately colored toner particles into contact with the selected image while the other development stations are out of operative relationship with the selected image to be developed. In this manner, the red latent electrostatic image is developed only with cyan toner particles, the green latent electrostatic image is developed only with magenta toner particles, and the blue latent elecrostatic image is developed only with yellow toner particles.

After the toner images have passed post-development erase lamp 56 to reduce the electrostatic bond between the toner image and belt 12, a copy sheet 74 is fed from supply 76 by means of feed roller 78 and registered by mechanism 80 with the first toner image on belt 12 in advance of transfer charger 62. As described in greater detail in the above-mentioned U.S. Pat. No. 4,410,263, tow-bar 58 is positioned adjacent to belt 12 opposite roller 16 to capture the lead edge of copy sheet 74. After the lead edge is captured, stepper motor 118 rotates sheet 74 around path 120 while passing it under transfer charger 62 which transfers the first toner image from belt 12 to sheet 74. The tangential velocity of the tow bar is matched to the velocity of belt 12 to avoid image smear. The length of path 120 is equal to the dimension of one image area of belt 12 (in the direction of web travel) plus the interframe distance between two adjacent areas.

As tow bar 58 returns the lead edge of sheet 74 into contact with belt 12, the trail edge of sheet 74 will be captured by bar 58 in juxtaposition with the lead edge. Continued movement of belt 12 and synchronized rotation of tow bar 58 brings the lead edge of copy sheet 74 back into transferable relationship with belt 12 as the lead edge of the next toner image arrives at tow bar 58. At this point, sheet 74 remains tacked to bar 58 and the second toner image is transferred by transfer charger 62 in superimposed registration with the first toner image on sheet 74. The process is repeated until the second toner image has been transferred to sheet 74 and the leading edge of copy sheet 74 has been brought back into transferable relationship with the third toner image on belt 12 which is transferred by charger 62 in superimposed registration with the other two images on the one side of copy sheet 74. When the lead edge of copy sheet 74 is brought back into transferable relationship with belt 12 for the last time, the vacuum on tow bar 58 is interrupted to release sheet 74 from bar 58 so that it follows the path of belt 12. Copy sheet 74 will be carried by belt 12 to separation roller 14 and then by air transport 66 to fuser 68.

Successive multiple image copies having superimposed toner images are produced in the same way. Since three toner images are transferred to a single copy sheet, the number of copy sheets processed by copier 10 with a process rate of 60 copies per minute will be $\frac{1}{3}$ the simplex rate; i.e., 20 copies per minute. In the example described above, the spacing between the leading edges of successive sheets will be 30" and the spacing between the trailing edge of one sheet and the leading edge of the next sheet will be $21\frac{1}{2}''$.

It will be appreciated that in the multi-image simplex mode, more or less than three images may be superimposed to form a simplex copy. Thus, 2, 4, 5, or more images may be superimposed and in such case the effective copy sheet processing rate of the copier would be $\frac{1}{2}$, $\frac{1}{4}$, 1/5, or the like of the single-image simplex copy rate.

It will also be appreciated that instead of superimposing images one on top of the other in the multiple image mode that images may be matrixed. For example, an image of a form with blank spaces may have an image of detailed information filled in the spaces so that the two images are matrixed together to form one image. Moreover, in the multiple-image mode different segments of a copy sheet may receive different color images to produce a spot color type copy. Thus, for example, in a two-paragraph page, one paragraph may be in black and another paragraph in red with each paragraph being imaged separately onto the copy sheet. As with the superimposed multiple image mode, the copy sheet rate will be less than the simplex rate depending upon the number of images used to produce the final image.

It is thus seen that during period when the fuser is not fusing images to copy sheets, there will be a loss of thermal energy from the fuser along the copy sheet path. Such non-fusing periods include warm-up of the copier when it is initially powered on, stand-by of the copier between copy runs, and interframe periods between successive copy sheets. Such interframe periods may be long as when the copier is operating in the multi-image simplex mode or when operating in the single-image simplex mode and the interframe distance is more than minimal. The lost thermal energy (through convection, conduction, radiation) tends to heat up components adjacent the fuser such as the photoconductor to produce deleterious results such as image degradation. Moreover, unnecessary thermal loss when the fuser is inactive requires an undesirable increase in fuser power consumption.

According to the present invention, thermal conservation apparatus is provided in order to minimize the loss of thermal energy from fuser 68 along the copy sheet path. This reduces the heating of components around fuser 68 such as film belt 12 and lowers the amount of power consumed in fuser 68 in carrying out its fusing function.

Figure 2:
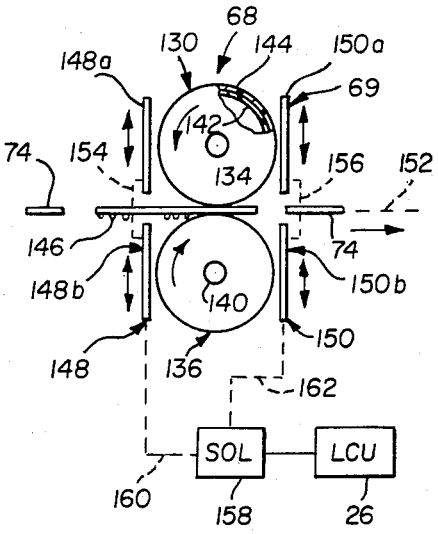
FIG. 2 is a partially-sectional, side elevational diagrammatic view of an embodiment of the thermal conservation apparatus of FIG. 1 shown in an open position.
Figure 3:
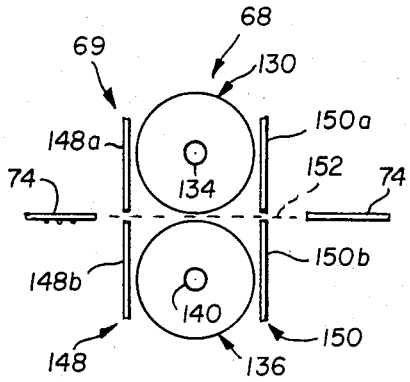
FIG. 3 is a side elevational diagrammatic view of the thermal conservation apparatus of FIG. 2 shown in the closed position.

Referring now to FIGS. 2 and 3, there is shown in more detail fuser 68 and one embodiment of thermal conservation apparatus according to the present invention. As shown, fuser 68 includes fuser rollers 130 with gudgeons 134 and fuser roller 136 with gudgeons 140. Rollers 130 and 136 may for example include a heat-conductive core of aluminum or the like such as core 142 of roller 130 and have an outer layer of a high-temperature resistant material which has good release properties such as silicone elastomeric layer 144 of roller 130. Either one or both of rollers 130, 136 are heated such as by internal heat sources (not shown). Rollers 130 and 136 are mounted for rotation in the frame (not shown) of copier 10 by gudgeons 134 and 140 respectively, and are held in pressure engagement to form a heated fusing nip in path 152 through which copy sheets 74 carrying toner images 146 pass to permanently fuse the toner image to copy sheet 74.

Thermal conservation apparatus 69 includes a gate assembly located adjacent to fuser 68 in copy sheet path 152. The gate assembly includes gate 148 located adjacent to the entrance to rollers 130, 136, and gate 150 located adjacent to the exit from rollers 130, 136. Gate 148 has upper member **148*a* and lower member 148*b* located on opposite sides of path 152 and gate 150 has upper member 150*a* and lower member 150*b* located on opposite sides of path 152. Gate members 148*a*, 148*b* are linked together by linkage 154, and gate members 150*a*, 150*b* are linked together by linkage 156. Opening and closing of gates 148, 150 is effected by a drive such as solenoid 158 linked to members 148*b*, 150*b* by linkages 160, 162 respectively. Solenoid 158 is selectively actuated by logic and control unit 26**.

As shown in FIG. 2, copy sheets 74 are moved along path 152 closely spaced together such as when copier 10 is operated in a single-image simplex mode and the interframe distance is minimal. In such case, gates 148 and 150 are maintained open between sheets to facilitate movement of sheets 74 through fuser 68. As shown in FIG. 3, however, gates 148 and 150 are shown closed in the interframe period between sheets 74 because such interframe distance is large either because copier 10 is operating in a multi-image simplex mode or in a single-image simplex mode where the spacing between sheets is more than minimal. In this manner, the loss of thermal energy from fuser 68 along path 152 is minimized.

It will be understood that gates 148 and 150 will also be closed during a warm-up period when copier 10 is initially powered on and also during stand-by periods between copy runs. It will also be understood that LCU 26 may cause solenoid 158 to open one of gates 148, 150 while closing the other gate to effect efficient management of thermal energy.

Figure 4:
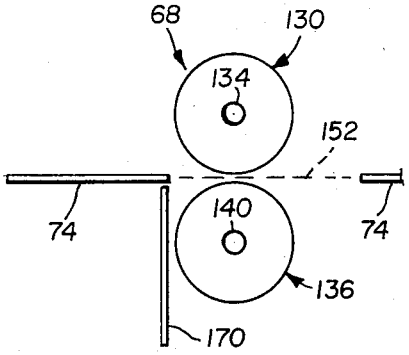
FIGS. 4 and 5 are side elevational, diagrammatic views of another embodiment of thermal conservation apparatus according to the present invention shown in the open and closed positions respectively.
Figure 5:
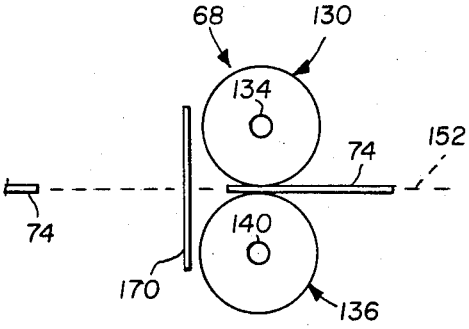

Referring now to FIGS. 4 and 5, there is shown another embodiment of thermal conservation apparatus according to the present invention. As shown, a gate assembly includes single gate member 170 which is shown in the open position in FIG. 3 to allow sheets 74 to pass and which is shown in the closed position in FIG. 5 to minimize the loss of thermal energy from fuser 68 along path 152.

Although the thermal conservation apparatus of the present invention as shown and described above is shown as including a gate assembly which blocks the copy sheet path to minimize loss of thermal energy, it will be understood that other thermal conservation apparatus may be provided which selectively encloses the entire fuser member during periods when copy sheets are not passing through the fuser. In addition, the thermal conservation apparatus may include more or less gate members than shown in the embodiments described above. It will also be understood that although a roller fuser has been shown that other types of heated fusers such as radiant fusers may be provided in which the thermal conservation apparatus of the present invention may be used.

Thus, it is seen that the thermal conservation apparatus according to the present invention has several advantages. Thermal energy produced in a heated fuser is conserved by minimizing the loss of thermal energy from the fuser during periods when copy sheets are not being processed such as during warm-up and stand-by periods and in the interframe interval between sheets when such interval is not minimal. This minimization of thermal energy loss improves copier operation by reducing the heating of the environment surrounding the heated fuser and of copier components such as the photoconductive member. Moreover, thermal conservation reduces the power requirements for the heated fuser. Morever, by maintaining the apparatus in an open position during interframe intervals which are minimal, the passage of sheets through the fuser is greatly facilitated.

The invention has been described in detail with particular reference to preferred embodiments thereof, but it will be understood that variations and modifications can be effected within the spirit and scope of the invention.

What is claimed is:

1. In reproduction apparatus in which copy sheets carrying unfused images are moved successively along a path through a heated fuser, thermal conservation apparatus comprising:

a selectively moveable gate assembly located adjacent to said heated fuser in said copy sheet path; and control means, coupled to said gate assembly, for opening said assembly to pass a copy sheet and for closing said gate assembly when a copy sheet is not passing to minimize the loss of thermal energy from said fuser along said copy sheet path.

2. The invention of claim 1 wherein said control means maintains said gate assembly continuously open when successive copy sheets are spaced closely together to facilitate movement of said sheets through said fuser.

3. The invention of claim 1 wherein said gate assembly includes first and second gates respectively located at the entrance and at the exit from said fuser.

4. The invention of claim 3 wherein said first and second gates respectively include members which are located on opposite sides of said path and which are selectively moveable to closed and open positions.

5. The invention of claim 1 wherein said gate assembly is located either at the entrance to or at the exit from said fuser.

6. The invention of claim 5 wherein said gate assembly includes members which are located on opposite sides of said path and which are selectively moveable to closed and open positions.

7. In a reproduction apparatus in which copy sheets carrying unfused images are moved successively along a path through a heated fuser, the improvement comprising:

means defining a moveable gate in said path for passing, when open, a copy sheet into or out of the fuser and for minimizing thermal energy loss along said path when closed;

means selectively responsive to the movement of a copy sheet in said path for opening the gate means prior to the arrival of a copy sheet at said gate means and for closing said gate means following passage of the copy sheet therefrom; and means for selectively holding said gate means open and for rendering said opening and closing means unresponsive to copy sheet movement to facilitate rapid and unobstructed movement of copy sheets through said fuser when successive copy sheets are moving in closely spaced relation along said path.

8. In electrographic apparatus in which copy sheets carrying unfused toner images are moved successively along a path through the nip formed by a pair of fuser members at least one of which is heated, thermal conservation apparatus comprising:

a selectively moveable gate assembly located adjacent to said nip of said fuser members in said copy sheet path; and control means coupled to said gate assembly, for opening said assembly to pass a copy sheet and for closing said gate assembly when a copy sheet is not passing to minimize the loss of thermal energy from said fuser members along said copy sheet path.

9. The invention of claim 8 wherein said control means maintains said gate assembly continuously open when successive copy sheets are spaced closely together to facilitate movement of said sheets through said fuser.

10. The invention of claim 8 wherein said gate assembly includes members which are located on opposite sides of said path and which are selectively moveable between to closed and open positions.

* * * * *